US008276526B2

(12) United States Patent
Verweij

(10) Patent No.: US 8,276,526 B2
(45) Date of Patent: Oct. 2, 2012

(54) ADJUSTING DEVICE

(75) Inventor: Jan Verweij, Zoetermeer (NL)

(73) Assignee: Vehold B.V., Zoetermeer (NL)

( * ) Notice: Subject to any disclaimer, the term of this patent is extended or adjusted under 35 U.S.C. 154(b) by 0 days.

(21) Appl. No.: 12/937,452

(22) PCT Filed: Apr. 9, 2009

(86) PCT No.: PCT/NL2009/050186

§ 371 (c)(1),
(2), (4) Date: Nov. 11, 2010

(87) PCT Pub. No.: WO2009/126036

PCT Pub. Date: Oct. 15, 2009

(65) Prior Publication Data

US 2011/0041739 A1 Feb. 24, 2011

(30) Foreign Application Priority Data

Apr. 11, 2008 (NL) ..... 2001472

(51) Int. Cl.
*A47B 9/00* (2006.01)

(52) U.S. Cl. ..... 108/147; 108/147.19; 248/188.5; 248/188.4

(58) Field of Classification Search ..... 108/147, 108/144.11, 147.11, 147.19, 148; 248/188.1, 248/188.2, 188.4, 188.5, 404, 405
See application file for complete search history.

(56) References Cited

U.S. PATENT DOCUMENTS

| | | | | |
|---|---|---|---|---|
| 3,887,155 | A * | 6/1975 | Bertalot | 108/147.19 |
| 5,289,782 | A * | 3/1994 | Rizzi et al. | 108/147 |
| 5,322,025 | A * | 6/1994 | Sherman et al. | 108/147 |
| 5,323,695 | A * | 6/1994 | Borgman et al. | 108/147 |
| 5,402,736 | A * | 4/1995 | Dausch | 108/147 |
| 5,447,099 | A * | 9/1995 | Adams et al. | 108/147 |
| 5,495,811 | A * | 3/1996 | Carson et al. | 108/147 |
| 6,148,741 | A * | 11/2000 | Motta | 108/147 |
| 6,263,809 | B1 * | 7/2001 | Wolters | 108/147 |
| 6,345,547 | B1 * | 2/2002 | Stoelinga et al. | 108/147 |
| 6,412,427 | B1 * | 7/2002 | Merkt | 108/147 |
| 6,474,246 | B2 * | 11/2002 | Hsu | 108/147 |
| 6,484,648 | B1 * | 11/2002 | Long | 108/147 |
| 6,494,005 | B2 * | 12/2002 | Zimmerman | 108/147 |
| 6,510,803 | B1 * | 1/2003 | Agee | 108/147 |
| 6,536,357 | B1 * | 3/2003 | Hiestand | 108/147 |
| 6,540,191 | B2 * | 4/2003 | Liu | 248/422 |
| 6,595,144 | B1 * | 7/2003 | Doyle | 108/147 |
| 6,682,030 | B2 * | 1/2004 | Santoro et al. | 248/188.5 |
| 6,705,239 | B2 * | 3/2004 | Doyle | 108/147 |
| 6,810,820 | B1 * | 11/2004 | Okerlund et al. | 108/147 |
| 7,908,981 | B2 * | 3/2011 | Agee | 108/147 |

FOREIGN PATENT DOCUMENTS

| | | |
|---|---|---|
| DE | 199 19 231 | 11/2000 |
| WO | WO 95/26660 | 10/1995 |

* cited by examiner

*Primary Examiner* — Jose V Chen
(74) *Attorney, Agent, or Firm* — Jordan IP Law, LLC

(57) ABSTRACT

An adjusting device having an inner tubular body, an outer tubular body configured to slide concentrically over the inner tubular body such that the inner tubular body and the outer tubular body can slide telescopically from a retracted position to an extended position. An actuator is configured to move the inner tubular body and the outer tubular body along the longitudinal axis in relation to one another and a supporting tube is provided and configured to slide concentrically on the inside of the outer tubular body.

19 Claims, 5 Drawing Sheets

ADJUSTING DEVICE

CROSS REFERENCE TO PRIOR APPLICATIONS

The present application is a National Stage Application of PCT International Application No. PCT/NL2009/050186 (filed on Apr. 9, 2009), under 35 U.S.C. §371, which claims priority to the Netherlands Patent Application No. 2001472 (filed on Apr. 11, 2008), which are each hereby incorporated by reference in their respective entireties.

BACKGROUND OF THE INVENTION

The invention relates to an adjusting device. The invention relates further to a piece of furniture provided with such an adjusting device. The invention relates further to a table provided with such an adjusting device.

In general, an adjusting device comprising an inner tubular body and an outer tubular body which can slide concentrically over the inner tubular body is widely known. Mutually extendable telescopic tubes have long been used to make an adjustable element. Multiple telescopic tubes are often used to enable an adjustment from a minimum starting position to an end position. The minimum starting length or starting position is often determined by the length of one tube. The maximum final length or end position is often determined by the sum of the lengths of the tubes, minus a certain overlap of each tube that is required to make the adjusting device stable in its final position. In the known adjusting devices with telescopic tubes, the overlap is a considerable portion of the tube length, especially when higher stability requirements are required.

DE-19959512 describes a device for adjusting the height of a table and the like, comprising two telescopic tubes equipped with an actuator, such as a gas-actuated spring. In the fully extended position, the two tubes overlap each other to a considerable degree. GB-1152363 and WO-02/085157 also describe such a device, wherein the actuation occurs by means of a spindle.

DE-19919231 and WO95/026660 also describe a table adjustable in height, provided with telescopic tubes. The stability of the telescopic tubes and the slackness are subject to improvement.

There is room for improvement in the adjusting devices that are already widely known in the prior art.

SUMMARY OF THE INVENTION

The object of the invention is to provide an improved or alternative adjusting device.

Furthermore, or additionally, or alternatively, the object of the invention is to provide an adjusting device which provides a high degree of rigidity or stability.

Furthermore, or additionally, or alternatively, the object of the invention is to provide an adjusting device that is easy and cheap to produce in quantity.

Furthermore, or additionally, or alternatively, the object of the invention is to provide an adjusting device which can withstand a high load.

To this end, the invention provides an adjusting device comprising an inner tubular body an outer tubular body that can slide concentrically over the inner tubular body so that the inner tubular body and the outer tubular body can slide telescopically from a retracted position to an extended position, an actuator for mutually sliding the inner tubular body and the outer tubular body along the longitudinal axis, and a supporting tube which can slide concentrically within the outer tubular body.

Due to the supporting tube, the inner tubular body and the outer tubular body can be almost entirely extended in respect of each other. In the fully extended position, the overlap may then still be very small. As a result, the smallest length is determined by the length of the longest tube, if there is a difference between the length of the tubes. The maximum length is almost entirely determined by the sum of the lengths of the inner tubular body and the outer tubular body. Moreover, the play of the adjusting device in its fully extended position is only minimal. Up till now, an adjusting device which has, for example, a length of 60 cm in its fully retracted position and a length of 120 cm in its extended position, was often constructed using three telescopic tubular bodies of approximately 45-60 cm, each overlapping each other by at least 10 cm in the extended position. The slackness of the entire adjusting device is then a sum of the play between the different tubes. In the invention, the total play is less than an individual play.

It may also be noted that, according to the invention, a tubular body may not only have a circular cross-section but also rectangular, polygonal or other cross-section. However, in connection with the cost price and availability of the basic parts, a circular tube, or a tubular body with a circular cross-section, would be the material of choice. However, it will be evident that this will not restrict the scope of the invention in any way.

In one embodiment, the supporting tube extends in the extended position in both directions past that end of the inner tubular body when at an end of that outer tubular body. In one embodiment thereof, the centre of the supporting tube is in the vicinity of the end of the inner tubular body. Because the supporting tube extends in both directions past an overlapping portion of the inner tubular body and outer tubular body, considerable rigidity is achieved.

In one embodiment, the inner tubular body and outer tubular body are each at least a few decimeters long and overlap by no more than a few centimeters in the extended position. Because of this, a large range of length is possible, whilst a high degree of rigidity is achieved by the supporting tube.

In one embodiment, the supporting tube is of the same order of length as the inner tubular body and outer tubular body and has a maximum length equal to that of the shortest of the tubes.

In one embodiment, the inner tubular body, outer tubular body and supporting tube are practically the same length.

In one embodiment, the supporting tube comprises stops at each end that are arranged so that they slide along the surface of the inner tubular body and outer tubular body respectively when the inner tubular body and outer tubular body are moved in respect of each other.

In one embodiment, the supporting tube is arranged within the inner tubular body.

In one embodiment, a substantial portion of the actuator is arranged within the supporting tube.

In one embodiment, the actuator comprises a spindle.

In one embodiment, the actuator comprises an electric motor.

In one embodiment, the actuator comprises a spindle and an electric motor to actuate the spindle. The described arrangements enable a simple construction. Further to this, said device is stable.

In one embodiment, the supporting tube comprises further engaging elements and the outer tubular body, the inner tubular body or the actuator have engaging elements that act in conjunction with these support-tube engaging elements. These can be arranged such that when the inner tubular body and the outer tubular body are extended out in respect of each other, one end of the supporting tube extends into the inner tubular body and one part of the supporting tube extends into the inner tubular body.

In one embodiment, the engaging elements are additionally arranged in order that, during extension, the supporting tube is carried along for a part of the range of extension so that the supporting tube extends partly into the inner tubular body and partly into the outer tubular body. In one embodiment, the supporting tube will extend approximately one half into the one tube and approximately one half into the other tube.

In one embodiment, the adjusting device has two telescopic tubes. It is of course conceivable to embody the adjusting device with more than two telescopic tube parts and with more than one supporting tubes. The second supporting tube can extend into the first supporting tube and into the next telescopic tube, for example.

The greatest rigidity and the greatest simplicity are achieved with two tubular bodies forming an inner tubular body and an outer tubular body (in relation to each other).

The invention relates further to a piece of furniture comprising an adjusting device according to the invention. The adjusting device is eminently suitable for this due to its high degree of stability. Furthermore, the adjusting device is compact and easy to integrate into a piece of furniture. Furthermore, the adjusting device can be produced in large numbers at a favourable price.

The invention relates further to a table comprising an adjusting device according to the invention.

In one embodiment of the table, one or more of the adjusting devices is incorporated into one or all of the table legs, the adjusting devices thus forming the table legs.

In one embodiment of the table, it comprises further a table top mounted on a support frame that is provided with at least two table legs that are each provided with the adjusting device.

In one embodiment of the table, this comprises an H-frame under the table top and two table legs, one end of which is connected to the H-frame and each provided at the opposite ends with a cross-tube.

When used for a table or other piece of furniture or workplace furniture, wherein the adjusting device is integrated into a table leg, the adjusting device has a great advantage. Notably, an inner tubular body and outer tubular body, each of approximately 60 cm in length, may be opted for. When fully retracted, the adjusting device then has a length of slightly more than 60 cm, which is approximately the height of a table. When fully extended, it is possible to achieve a length, i.e. a table height, of approximately 118 cm. In most cases this is a working height for a person standing.

The invention relates further to a device provided with one or more of the arrangements set forth in the accompanying description and/or shown in the accompanying drawings.

It will be evident that the various aspects disclosed in this patent application may be applied in conjunction with one another and that each aspect may be considered independently for the purpose of a divisional patent application. Accordingly, patent rights are provided for both a table and for a bicycle carrier, for example.

BRIEF DESCRIPTION OF THE FIGURES

The accompanying figures show an embodiment of an adjusting device according to the invention and applications thereof, wherein.

DESCRIPTION OF THE EMBODIMENTS

Figure 1:
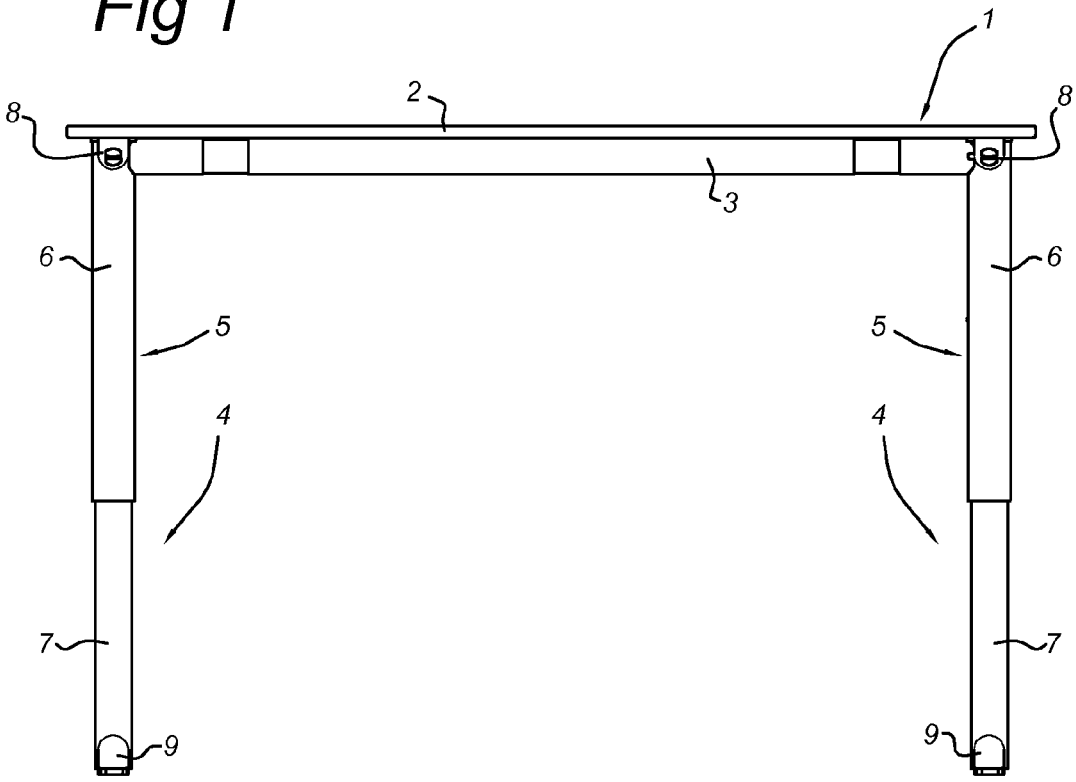
FIG. 1 shows a view of an embodiment of a table adjustable in height with the use of an adjusting device.
Figure 2:
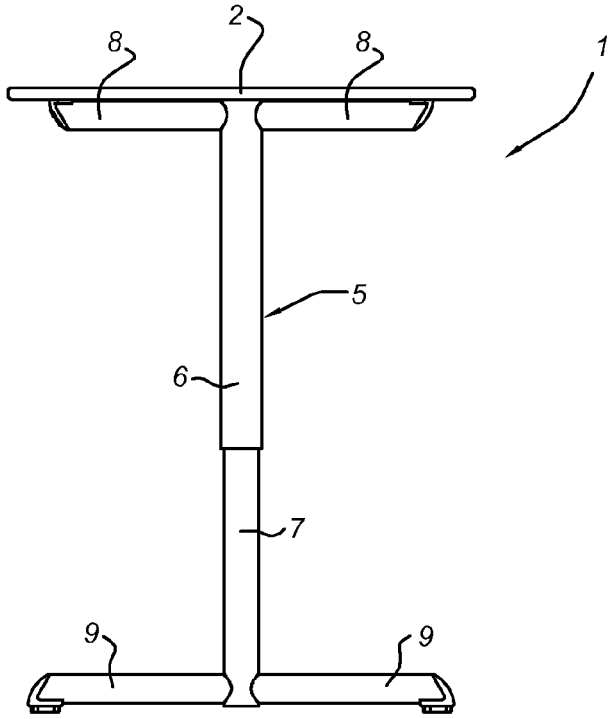
FIG. 2 shows a view of the table from FIG. 1.

FIG. 1 shows an embodiment of an application for an adjusting device according to the invention in a table 1. Table 1 has a table top 2. The table top 2 rests on a frame, in this embodiment comprising a cross-beam 3 extending along the length of the table. At the ends, the cross-beam 3 shown here has transversely extending side-beams 8 on which the table top rests. The legs 4 extend outwardly at the end of the beam or tubular body 3. The two legs 4 in this embodiment are each provided with an adjusting device 5. The adjusting devices of the legs 5 have an outer tubular body 6 in which a telescopically extendable inner tubular body 7 is arranged. Next to the end of the legs 4, situated opposite the support frame upon which the table top 2 rests, the inner tubular body 7 is provided with tube sections which extend here perpendicular to the longitudinal direction of the table legs 4. FIG. 2 shows a side-view of this table 1 of FIG. 1. In this embodiment, the various tubes 3, 8, 6, 7 and 9 are substantially circular tubular bodies. It is equally conceivable, of course, that these tubular bodes are not circular but that they may also be rectangular, polygonal, triangular or elliptical, for example. In the embodiment shown, it can be seen in FIG. 1 that the tubular body 3, which forms a part of the frame which supports the table, the so-called support frame that is composed of tubular sections 3 and laterally extending tubular sections 8, is extendable and adjustable in length. In this manner, the same support frame can be used for different lengths of table top. Moreover, in the embodiment shown, no cross-beam is provided at a lower level, so that a free workspace is created beneath the table 1.

Figure 3:
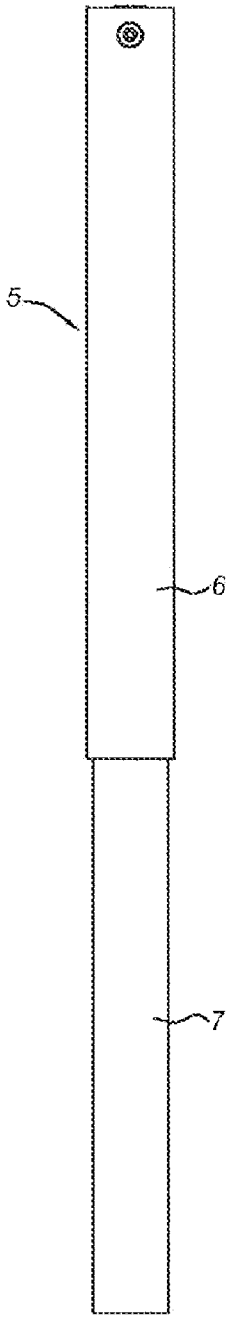
FIG. 3 shows a side view of an embodiment of an adjusting device.
Figure 4:
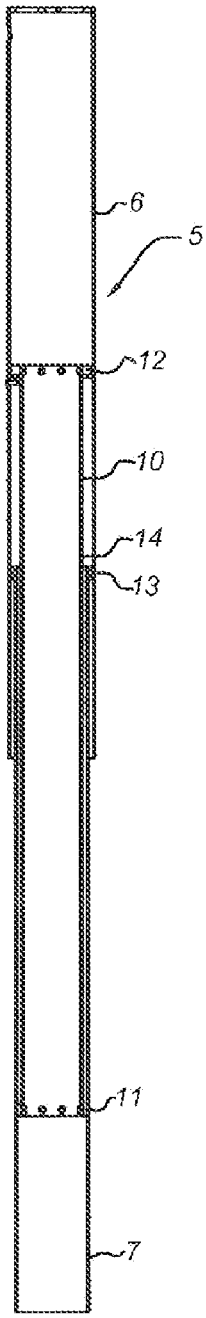
FIG. 4 shows a partial longitudinal cross-section through the adjusting device of FIG. 3.
Figure 5:
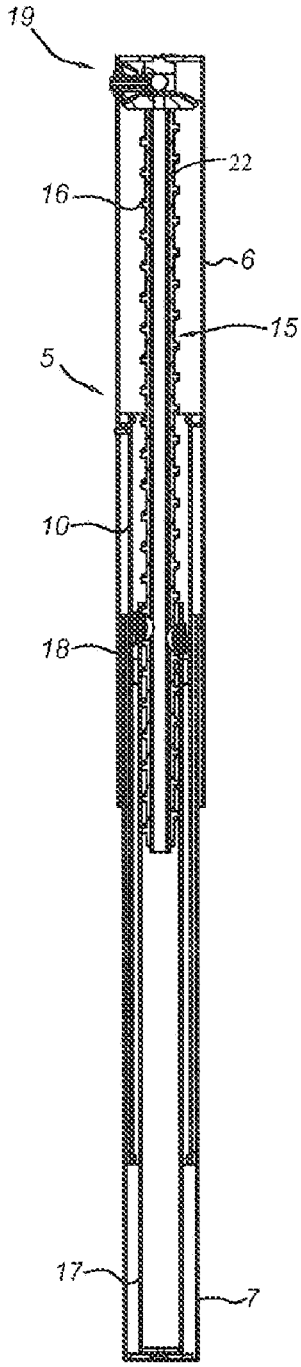
FIG. 5 shows a longitudinal cross-section through the adjusting device of FIG. 3.

FIGS. 3, 4 and 5 show details of an embodiment of an adjusting device according to one embodiment of the invention. Such an adjusting device 5 is used, for example, for the table as shown in FIGS. 1 and 2. FIG. 3 shows a side-view of the adjusting device 5 with the inner tubular body 7 and the telescopic outer tubular body 6 that can slide over it. FIG. 4 shows a transverse section of the adjusting device 5. It can be seen in this transverse section that the adjusting device is provided with a supporting tube 10, which is positioned here inside the inner tubular body 7. The supporting tube 10 can also slide within the inner tubular body and outer tubular body. In order to eliminate play between the tubes, which can result in movement between the outer tubular body and inner tubular body perpendicular to the longitudinal axis or longitudinal direction of the tubes 6, 7, the supporting tube 10 and the inner tubular body 7 and the outer tubular body 6 are both provided with various stops at their respective ends. The tubes therefore lie in abutment with each other. To this end, the supporting tube 10 is provided at its respective ends with stops 11 and 12. The stop 11 is arranged to lie in abutment with the inside of the inner tubular body 7 and the stop 12, at the opposite end of the supporting tube 10, is arranged to lie in abutment with the inside of the outer tubular body 6. In order to further reduce the play in the adjusting device, so as to create high rigidity or to restrict movement and play perpendicular to the longitudinal direction of the adjusting device, the end of outer tubular body 6 positioned next to the inner tubular body is also additionally provided with a stop at its end that can slide along the tube and lie in abutment with the outer surface of the inner tubular body 7. This stop is not shown in FIG. 4. Additionally, the end of the inner tubular body 7 positioned inside the outer tubular body 6 is also provided with a stop 13 which lies in abutment with the inner surface of the outer tubular body 6.

The stops mentioned are arranged in such a manner that they simply slide along the inner surfaces or outer surfaces of the tubes 6, 7, 10 respectively. In a simple embodiment, for example, these stops can be formed as plastic rings, made from nylon or another material, which can be positioned on top of the tube ends and extend outwardly from the tube surfaces or, if necessary, extend along the inner tube surfaces. If the tubes are made of metal, such as iron or steel, or indeed aluminium, a ring made from nylon material, for example, will slide correctly along the metal surface. Alternatively, the stops can be formed in a more complex manner, for example, as small rings or wheels whose axes lie in a plane which is normally equal to the longitudinal axis or longitudinal direction of the tubes. These small wheels will then run along the inner surface or outer surface of the tubes.

The inner tubular body 7 and the outer tubular body 6 can be telescopically adjusted in relation to one other by means of an actuator. FIG. 5 shows an embodiment of an actuator. An example of a possible actuator 15 is described in detail in the Dutch patent NL1031787. Here, the adjusting device is shown in which this actuator 15 is used. The actuator 15 shown in this embodiment of the adjusting device is provided with a spindle 16 and rollers 18 running therein, forming part of a spindle nut. The rollers 18 are mounted with their axes of rotation almost perpendicular to the direction of the spindle. The rollers or wheels 18 run with their peripheral surfaces along the grooves 22 of the spindle 16. The spindle 16 is mounted within a further spindle tube 17 which is positioned within the inner tubular body 7 and within the supporting tube 10. Here, on the lower side, the spindle tube 17, in which the spindle 16 is movable, is attached to or near to the lower side of the inner tubular body 7. At the top of the spindle tube 17, the rollers are mounted on the inside of the spindle tube 17. The supporting tube 10 is provided with engaging elements on the inside which act cooperatively with the engaging elements of the actuator 15. In this embodiment, the spindle 16 will have engaging elements. Accordingly, when the actuator 15 is activated for telescopic extension of the inner tubular body 7 in respect of the outer tubular body 6, the supporting tube 10 will be moved upwardly along with it. The actuator is additionally provided with a device by which the supporting tube is not moved more than half way along the outer tubular body 6. In one embodiment, the spindle 16 will have grippers up to half way along the spindle 16.

On its upper side, the spindle 16 is provided with a linkage element 19, in this case a perpendicular linkage element actuated by means of an actuating shaft positioned perpendicular to the longitudinal direction of the spindle 16. In a starting position, i.e. a retracted position, the spindle 16 will be positioned almost entirely within the spindle tube 17. The outer tubular body 5 is almost entirely slipped over the inner tubular body 7 and the lower side of the supporting tube 10 will also rest on the lower side of the inner tubular body 7. When the spindle 16 is brought into rotation by means of the linkage 19, it will automatically be pushed upwards as a result of the helical thread of the spindle running in the rollers 18. The spindle tube 17 will remain at rest at the underside of the inner tubular body 7. The rotating spindle will move the supporting tube 10 upwards along with it, up to a certain height. In general, the position shown in FIG. 5 will not yet be the fully extended position. In practice, both the tubes will be capable of extending further, so that the inner tubular body 7 and the outer tubular body 5 will only overlap each other for a very small part. For example, when used in a table leg, as shown in FIGS. 1 and 2, the inner tubular body 7 will have a length of approximately 60 to 65 centimeters and the outer tubular body 5 will have a corresponding length. Therefore, a table 1 can then be created that is adjustable between a height of approximately 60 centimeters and a fully extended approximate height of almost 120 centimeters. Such a table is suitable for sitting at, and, in the highest position, to stand and work at.

Figure 6:
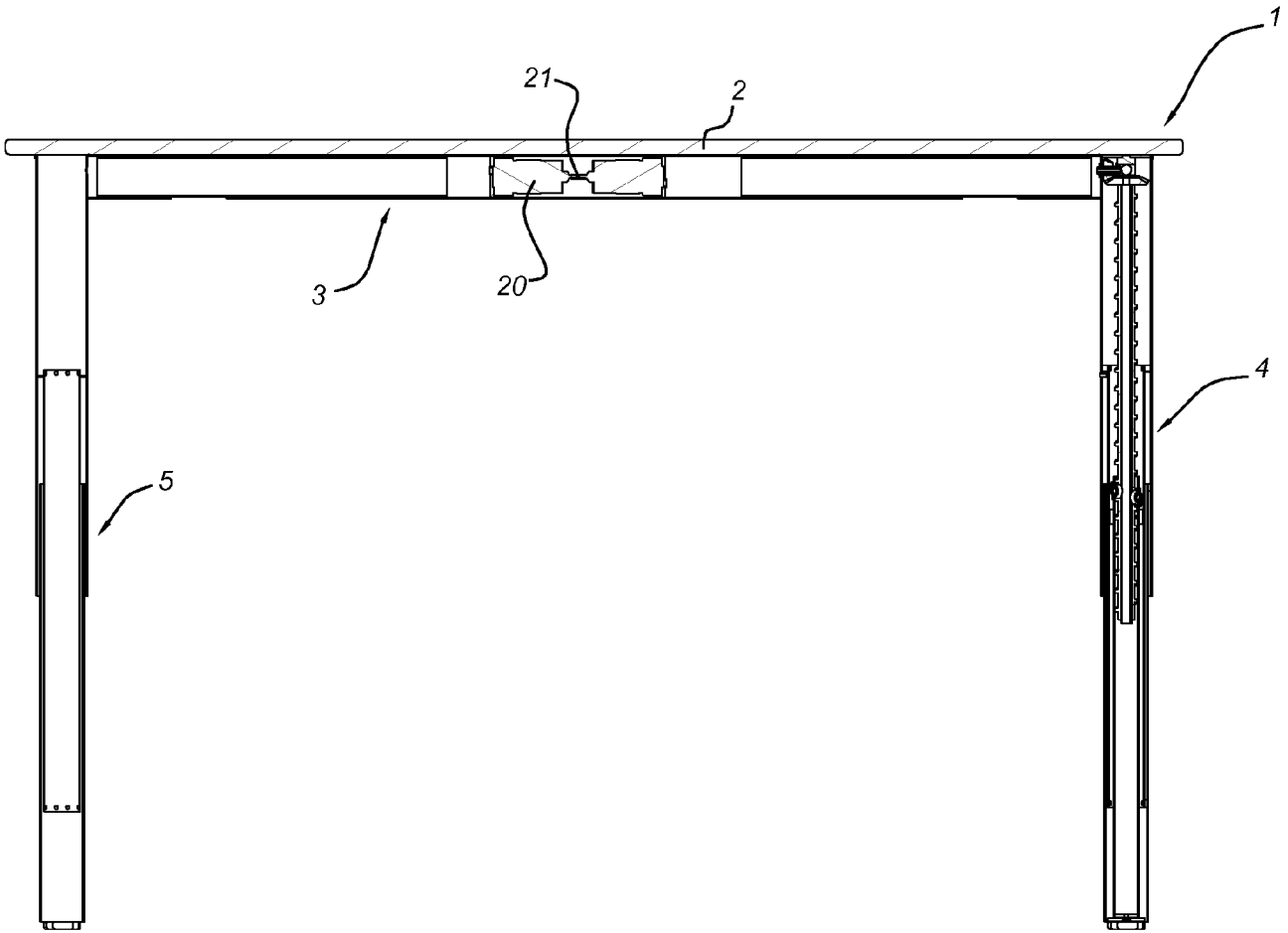
FIG. 6 shows a cross-section through the table of FIG. 1 with the adjusting device of FIGS. 3-5.

FIG. 6 shows the table in FIGS. 1 and 2 in transverse section, wherein the different components of this height-adjustable table are clearly indicated. It can be seen that a pair of electric motors 20, which are connected to each other by their anchors, are located inside the tube 3 that extends along the length of the table. These electric motors 20 are for actuating the drive shaft of the linkage 19 element that actuates the spindle 16. For example, the electric motors 20 can be powered from a battery pack that is mounted in one of the cross-tubes 8. Such a battery pack can, for example, be detachable for external charging, or chargeable by means of an adapter in the table. Since the anchors 21 of the electric motors 20 are jointly connected, synchronization is easy to achieve. On the left side, the table leg with the adjusting device 5 is shown without the actuator, and on the right leg, the actuator is also made visible.

If desired, the adjusting device 5 can also be actuated by means of other conceivable actuators. Accordingly, another embodiment of a spindle and spindle nut is also conceivable and may also be actuated by an electric motor. Alternatively, the adjusting device could be actuated by means of cables, wherein both tubes can be forced apart. In another embodiment, a gas-actuated spring could be chosen for this purpose, or actuation could be assisted by means of a gas-actuated spring. The adjusting device can also be actuated by means of a hydraulic device, for example.

FIGS. 7 to 10 show an application of the adjusting device of FIGS. 3-5 for lifting a bicycle, for a bicycle carrier. Here, because it is very stable, the adjusting device forms part of the bicycle carrier.

Figure 7:
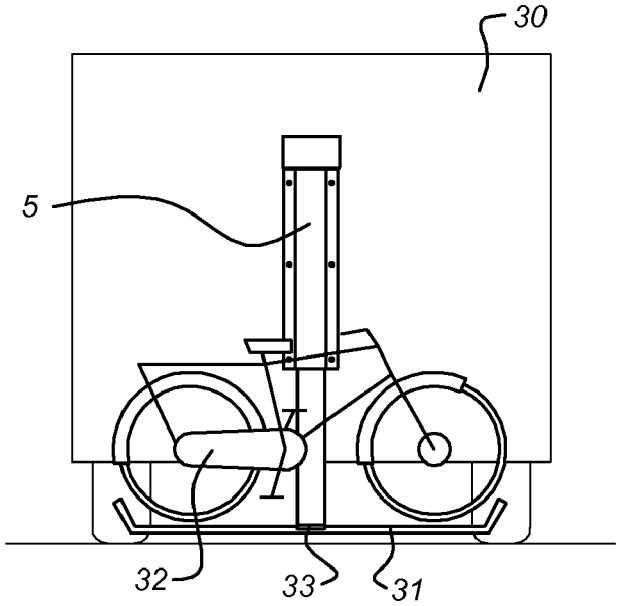
FIGS. 7-10 shows various views of an application for the adjusting device of FIGS. 3-5 in a bicycle carrier.
Figure 8:
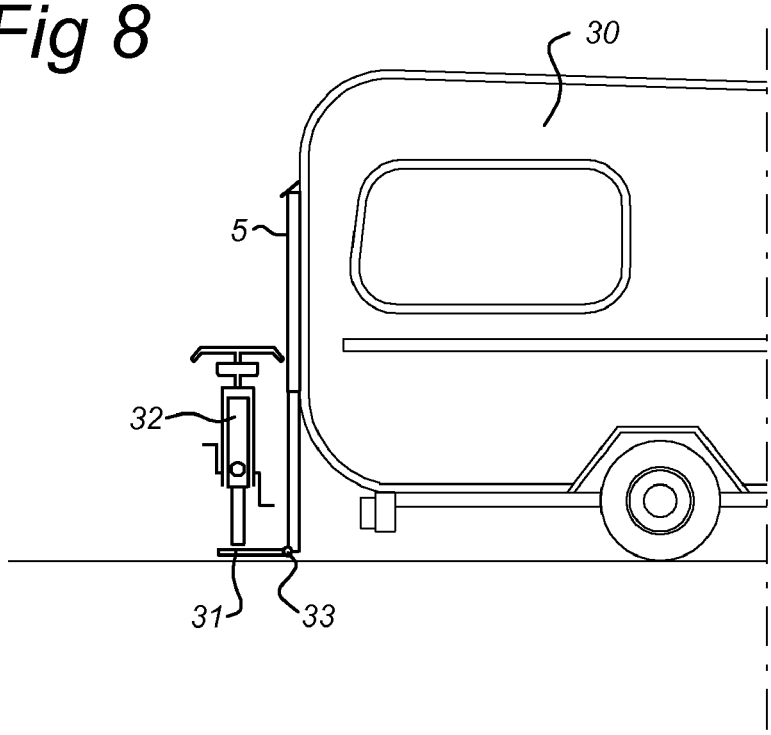
Figure 9:
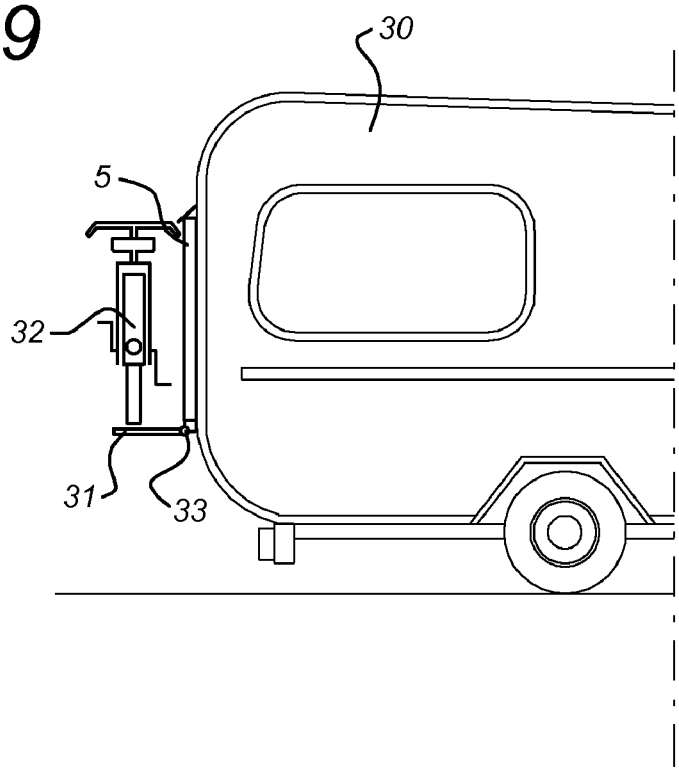

FIG. 7 shows the rear end of a caravan or camper 30 to which the adjusting device 5 is mounted. Here, the inner tubular body of the adjusting device 5 is fixed to the rear end of the camper. A frame 31, on which a bicycle can rest, is fixed to the end of the inner tubular body of the adjusting device 5. FIG. 8 shows a side-view of this application of the adjusting device. In this case, the carrier frame 31, on which the bicycle rests, can be hinged on the hinge 33, which is connected to the end of the inner tubular body of the adjusting device 5. The adjusting device 5 is shown here in the extended position. FIG. 9 shows the adjusting device 5 in the retracted position, wherein the bicycle 32, resting on the frame 31, is lifted off the ground and is positioned behind the camper or caravan 30.

Figure 10:
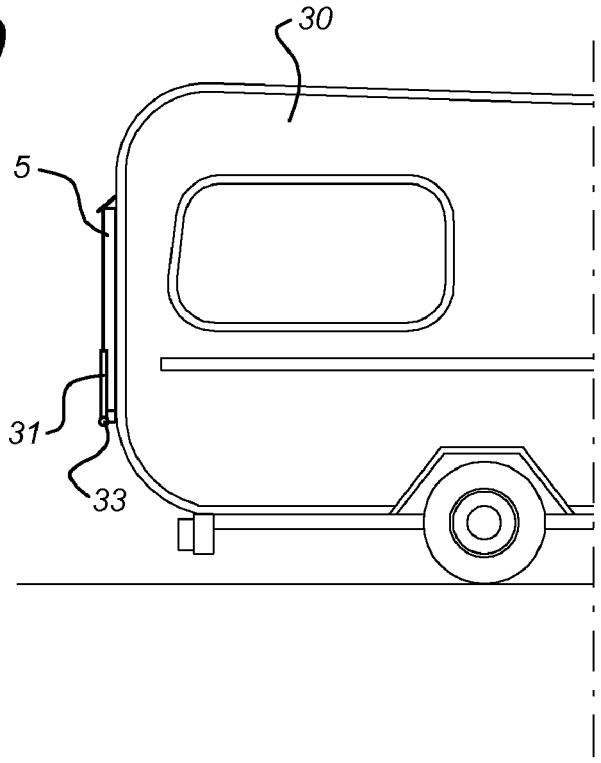

FIG. 10 shows the bicycle carrier without the bicycle, wherein the frame 31 is folded inwardly against the adjusting device 5 when not in use.

For ease of use, the bicycle carrier may be equipped with an electric motor as part of the actuator. Additionally, the bicycle carrier may have batteries for powering the electric motor. The battery may be rechargeable by means of a solar energy panel (shown tilted in the figure). The bicycle carrier may be operable by means of remote control.

It will be evident that the above description is included in order to illustrate the operation of the embodiment of the invention and not to limit the scope of the invention. From the above description, many variations may become apparent to those skilled in the art, which fall within the scope and spirit of the present invention.

The invention claimed is:

1. An adjusting device comprising:

an outer tubular body;

an inner tubular body positioned concentrically relative to the outer tubular body; and an actuator configured to telescopically adjust in a longitudinal direction the inner and outer tubular bodies with respect to one another, the actuator including:

a supporting tube positioned concentrically inside the inner tubular body and configured to move simultaneously with the inner tubular body relative to the outer tubular body, the supporting tube having at a first end thereof a first stop which abuts the inside surface of the inner tubular body and at a second end thereof a second stop which abuts the inside surface of the outer tubular body, the first and second stops configured to restrict lateral movement of the inner and outer tubular bodies with respect to the longitudinal axis of the inner and outer tubular bodies;

a spindle provided with a plurality of grooves extending along the longitudinal thereof; and rollers mounted with their axes of rotation substantially perpendicular to the spindle, wherein the rollers are configured to rotate with their peripheral surfaces along the grooves.

2. The adjusting device of claim 1, wherein the end of the inner tubular body is provided with a third stop which abuts the inner surface of the outer tubular body.

3. The adjusting device of claim 1, wherein the inner tubular body and the outer tubular body are each provided with a stop at respective ends thereof.

4. The adjusting device of claim 3, wherein each stop is configured to move along one of the inner surfaces and the outer surfaces of the inner tubular body, the outer tubular body and the supporting tube, respectively.

5. The adjusting device of claim 1, wherein the actuator further comprises:

a linkage element configured to cause rotation of the spindle;

a drive shaft configured to actuate the linkage element and positioned perpendicular to the longitudinal direction of the spindle; and a motor configured to actuate the drive shaft.

6. The adjusting device of claim 5, wherein the spindle, when rotating, moves the supporting tube upwards simultaneously with the inner tubular body such that the inner tubular body and the outer tubular body will overlap each other.

7. An adjusting device comprising:

a first tubular body;

a second tubular body positioned concentrically inside the first tubular body and configured for longitudinal movement relative to the first tubular body; and an actuator configured to telescopically move the first tubular body and the second tubular body between a retracted position and an extended position, respectively, the actuator including a third tubular body positioned concentrically inside the second tubular body and configured for movement relative to the first tubular body and the second tubular body, a spindle tube positioned concentrically in the third tubular body, a spindle positioned for movement in the spindle tube and provided with a plurality of grooves extending along the longitudinal thereof, and rollers mounted with their axes of rotation substantially perpendicular to the spindle, wherein the third tubular body has at a first end thereof a first stop which abuts the inside surface of the first tubular body and at a second end thereof a second stop which abuts the inside surface of the second tubular body to thereby restrict lateral movement of the first and second tubular bodies with respect to the longitudinal axis thereof.

8. The adjusting device of claim 7, wherein the spindle tube is attached at a lower portion thereof to the second tubular body.

9. The adjusting device of claim 7, wherein the rollers are mounted on the inside of the spindle tube at the upper portion of the spindle tube.

10. The adjusting device of claim 7, wherein the actuator further comprises:

a linkage element configured to cause rotation of the spindle;

a drive shaft configured to actuate the linkage element and positioned perpendicular to the longitudinal direction of the spindle; and a motor configured to actuate the drive shaft.

11. The adjusting device of claim 7, wherein the actuator is configured to move the second tubular body and the third tubular body simultaneously with respect to the first tubular body.

12. The adjusting device of claim 7, wherein the first tubular body and the second tubular body are each provided with a stop at respective ends thereof.

13. The adjusting device of claim 12, wherein each stop is configured to move along one of the inner surfaces and the outer surfaces of the first tubular body, the second tubular body and the third tubular body, respectively.

14. A height adjustable table comprising:

a top;

a frame including a cross-beam having at ends thereof transversely extending side-beams upon which the top rests;

legs, each telescopically movable via a device configured to adjust the height of the top relative to a surface which supports the height adjustable table, the device including:

an inner tubular body;

an outer tubular body positioned concentrically to the inner tubular body and configured to slide over the inner tubular body; and an actuator configured to telescopically move the inner tubular body and the outer tubular body between a retracted position and an extended position, respectively, the actuator including a supporting tube positioned concentrically inside the inner tubular body and configured to move relative to the inner tubular body and the outer tubular body, a spindle tube positioned concentrically in the supporting tube, a spindle positioned for movement in the spindle tube and provided with a plurality of grooves extending along the longitudinal thereof, a linkage element configured to cause rotation of the spindle, the linkage element being actuated by way of a drive shaft positioned perpendicular to the longitudinal direction of the spindle, and a motor located inside the cross-beam and configured to actuate the drive shaft.

15. The adjusting device of claim 14, wherein in the retracted position, the spindle is positioned substantially entirely within the spindle tube.

16. The adjusting device of claim 14, wherein the spindle is caused to move upwardly via the linkage element.

17. The adjusting device of claim 14, wherein the spindle, when rotating, moves the supporting tube upwards simultaneously such that the inner tubular body and the outer tubular body will overlap each other.

18. The adjusting device of claim 14, wherein the motors are jointly connected via anchors to thereby obtain synchronous telescopic movement of the legs with respect to each other.

19. The adjusting device of claim 14, wherein the actuator further comprises rollers mounted with their axes of rotation substantially perpendicular to the spindle.

* * * * *